US011179931B2

(12) United States Patent
Yamaguchi et al.

(10) Patent No.: US 11,179,931 B2
(45) Date of Patent: Nov. 23, 2021

(54) EJECTING APPARATUS AND METHOD OF CONTROLLING LIQUID EJECTING APPARATUS

(71) Applicant: SEIKO EPSON CORPORATION, Tokyo (JP)

(72) Inventors: Kei Yamaguchi, Matsumoto (JP); Daisuke Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/854,361

(22) Filed: Apr. 21, 2020

(65) Prior Publication Data

US 2020/0331258 A1 Oct. 22, 2020

(30) Foreign Application Priority Data

Apr. 22, 2019 (JP) ..... JP2019-080612

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC . B41J 2/04541; B41J 2/04596; B41J 2/04588
See application file for complete search history.

(56) References Cited

U.S. PATENT DOCUMENTS 7,618,106 B2 * 11/2009 Usui ..... B41J 2/04541 347/9
8,485,625 B2 * 7/2013 Miyazawa ..... B41J 2/04541 347/11
2011/0316915 A1 * 12/2011 Matsushita ..... B41J 2/04588 347/10
2014/0063104 A1 * 3/2014 Somete ..... B41J 2/04513 347/14

FOREIGN PATENT DOCUMENTS

JP 2013-082154 5/2013
JP 2015-168138 9/2015
JP 2017-128032 7/2017

* cited by examiner

*Primary Examiner* — Lam S Nguyen
(74) *Attorney, Agent, or Firm* — Workman Nydegger

(57) ABSTRACT

A liquid ejecting apparatus according to an aspect of the present disclosure has a nozzle configured to eject a liquid, a pressure chamber communicating with the nozzle, a piezoelectric element that varying pressure in the pressure chamber, an endless transport belt transporting a medium, an electrifying section electrifying the transport belt, and a driving circuit that supplying, to the piezoelectric element, a micro-vibration pulse that generates micro-vibration in the liquid in the pressure chamber without causing the liquid to be ejected from the nozzle. The micro-vibration pulse is varied according to first data related to the state of a meniscus in the nozzle in a first state in which the nozzle and the transport belt electrified by the electrifying section face each other.

11 Claims, 7 Drawing Sheets

EJECTING APPARATUS AND METHOD OF CONTROLLING LIQUID EJECTING APPARATUS

The present application is based on, and claims priority from JP Application Serial Number 2019-080612, filed Apr. 22, 2019, the disclosure of which is hereby incorporated by reference herein in its entirety.

BACKGROUND

1. Technical Field

The present disclosure relates to a liquid ejecting apparatus and a method of controlling the liquid ejecting apparatus.

2. Related Art

Liquid ejecting apparatuses proposed in related art eject liquid such as ink to a medium such as a print sheet. JP-A-2013-82154, for example, discloses a liquid ejecting apparatus that has an endless transport belt that transports a medium and also has an electrifying section that electrifies the transport belt. When the electrifying section electrifies the transfer belt, the medium adheres to the transport belt. With the technology in JP-A-2013-82154, very small vibration is generated in liquid to the extent that the liquid is not ejected (vibration of this type will be referred to below as micro-vibration) to suppress an increase in the viscosity of the liquid.

With the technology in JP-A-2013-82154, charges on the transport belt affect the meniscus of the liquid. For example, charges on the transport belt draw the meniscus of the liquid toward the transport belt. This produces the possibility that the agitation of the liquid by micro-vibration is suppressed unlike when the transport belt is not electrified.

SUMMARY

To solve the above problem, a liquid ejecting apparatus according to an aspect of the present disclosure has a nozzle that ejects a liquid, a pressure chamber communicating with the nozzle, a piezoelectric element that varies pressure in the pressure chamber, an endless transport belt that transports a medium, an electrifying section that electrifies the transport belt, and a driving circuit that supplies, to the piezoelectric element, a micro-vibration pulse that generates micro-vibration in the liquid in the pressure chamber without causing the liquid to be ejected from the nozzle. The micro-vibration pulse is varied according to first data related to the state of a meniscus in the nozzle in a first state in which the nozzle and the transport belt electrified by the electrifying section face each other.

To solve the above problem, a liquid ejecting apparatus controlling method according to another aspect of the present disclosure is a method of controlling a liquid ejecting apparatus that has a nozzle that ejects a liquid, a pressure chamber communicating with the nozzle, a piezoelectric element that varies pressure in the pressure chamber, an endless transport belt that transports a medium, an electrifying section that electrifies the transport belt, and a driving circuit that supplies, to the piezoelectric element, a micro-vibration pulse that generates micro-vibration in the liquid in the pressure chamber without causing the liquid to be ejected from the nozzle. The method controls the micro-vibration pulse according to first data related to the state of a meniscus in the nozzle in a first state in which the nozzle and the transport belt electrified by the electrifying section face each other.

DESCRIPTION OF EXEMPLARY EMBODIMENTS

A: First Embodiment

Figure 1:
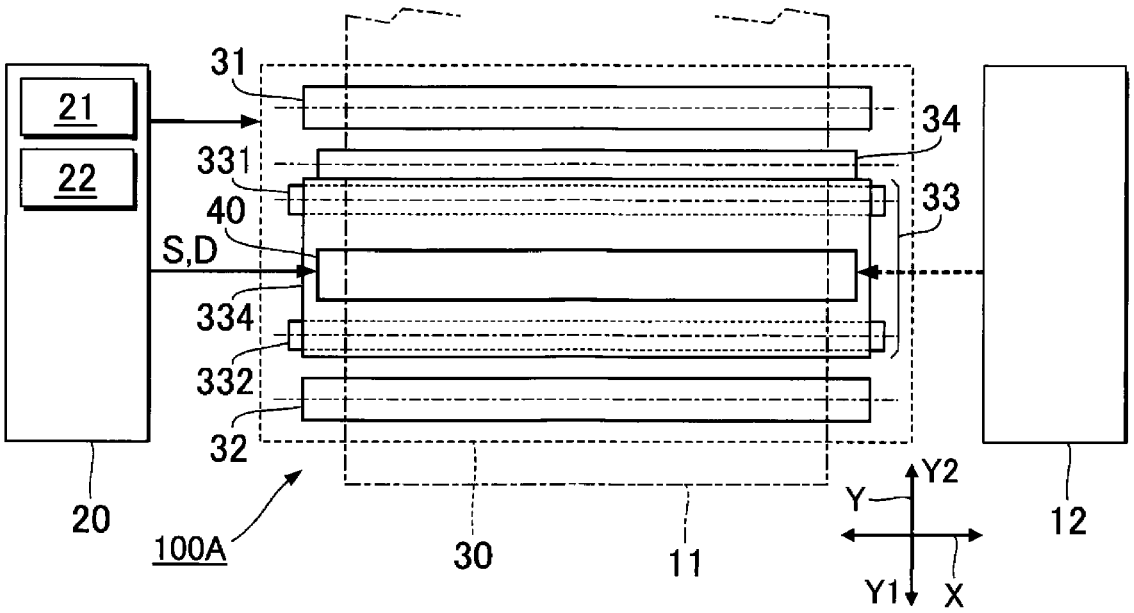
FIG. 1 is a block diagram illustrating the structure of a liquid ejecting apparatus according to a first embodiment.
Figure 2:
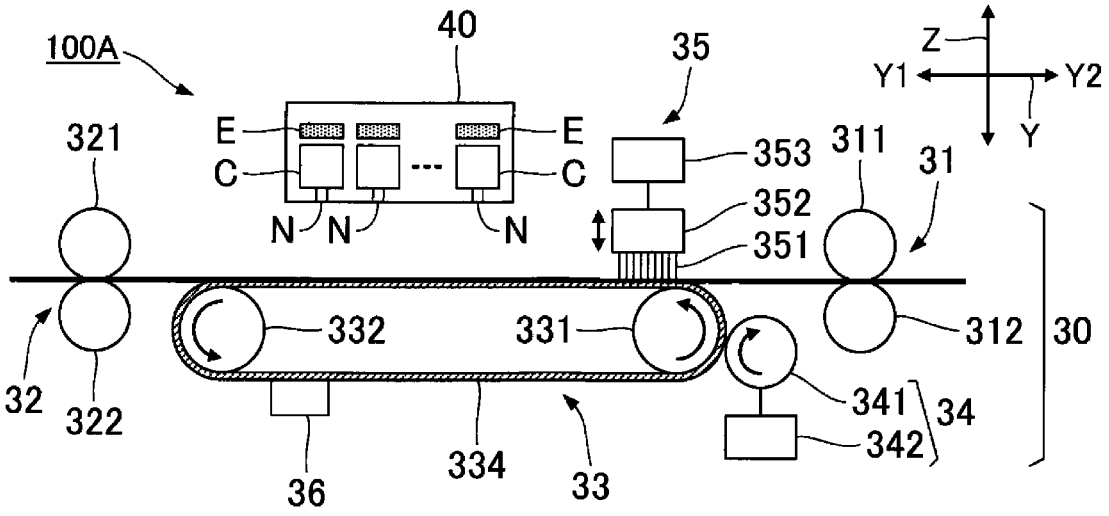
FIG. 2 is a side view of the liquid ejecting apparatus.

In the description below, an X-axis, a Y-axis, and a Z-axis that are mutually orthogonal are assumed, as illustrated in FIGS. 1 and 2. A direction along the Y-axis when viewed from an arbitrary point will be referred to as the Y1 direction, and a direction opposite to the Y1 direction will be referred to as the Y2 direction. An X-Y plane including the X-axis and Y-axis is equivalent to a horizontal plane. The Z-axis is an axis along the vertical direction. A view of an object taken from the Z-axis direction will be referred to below as a plan view.

FIG. 1 partially illustrates the structure of a liquid ejecting apparatus 100A according to a first embodiment. The liquid ejecting apparatus 100A in the first embodiment is an ink jet printing apparatus that ejects droplets of ink, which is an example of liquid, to a medium 11. The medium 11 is, for example, a print sheet. Any material eligible for printing such as a resin film or cloth is used as the medium 11. In the liquid ejecting apparatus 100A, a liquid container 12 is mounted. The liquid container 12 holds ink. Examples used as the liquid container 12 are a cartridge detachably mounted in the liquid ejecting apparatus 100A, a bag-like ink pack formed from a flexible film, and an ink tank that can be replenished with ink. Any number of types of inks may be held in the liquid container 12.

As illustrated in FIG. 1, the liquid ejecting apparatus 100A has a control unit 20, a transport mechanism 30, and a liquid ejecting head 40. The control unit 20 controls elements in the liquid ejecting apparatus 100A. The control unit 20 has, for example, a control device 21 and a storage device 22. The control device 21 is composed of one or a plurality of processors that perform various computations and control. Specifically, the control device 21 is composed of one or more types of processors including a central processing unit (CPU), a graphic processing unit (GPU), a digital signal processor (DSP), and a field programmable gate array (FPGA), for example.

The storage device 22 is composed of one or a plurality of memories that store programs executed by the control device 21 and various types of data used by the control device 21. Examples used as the storage device 22 include known recording media such as semiconductor recording media and magnetic recording media and also include a combination of a plurality of types of recording media.

FIG. 2 is a side view of the liquid ejecting apparatus 100A when viewed from the X-axis direction. The transport mechanism 30 transports a medium 11 along the Y-axis under control of the control unit 20. As illustrated in FIGS. 1 and 2, the transport mechanism 30 in the first embodiment has a supply mechanism 31, a discharging mechanism 32, a support mechanism 33, an electrifying section 34, a first destaticizing device 35, and a second destaticizing device 36.

The supply mechanism 31, which includes a first supply roller 311 and a second supply roller 312, supplies a medium 11 to the support mechanism 33. The rotation axes of the first supply roller 311 and second supply roller 312 are parallel to the X-axis. When one or both of the first supply roller 311 and second supply roller 312 are rotated, the medium 11 passes between the first supply roller 311 and the second supply roller 312 and is then transported in the Y1 direction. The support mechanism 33 supports the medium 11. The supply mechanism 31 is positioned more on the Y2-direction side than is the support mechanism 33. The discharging mechanism 32 is positioned more on the Y1-direction side than is the support mechanism 33.

The discharging mechanism 32, which includes a first discharging roller 321 and a second discharging roller 322, discharges a medium 11 from the liquid ejecting apparatus 100A. The rotation axes of the first discharging roller 321 and second discharging roller 322 are parallel to the X-axis. When one or both of the first discharging roller 321 and second discharging roller 322 are rotated, the medium 11 passes between the first discharging roller 321 and the second discharging roller 322 and is then transported in the Y1 direction.

The support mechanism 33 has a first transport roller 331, a second transport roller 332, and a transport belt 334. The rotation axes of the first transport roller 331 and second transport roller 332 are parallel to the X-axis. The first transport roller 331 and second transport roller 332 are spaced in the Y-axis direction. The transport belt 334 is an endless belt wound around the first transport roller 331 and second transport roller 332. Therefore, the direction of the X-axis is equivalent to the width direction of the transport belt 334. The transport belt 334 is formed from, for example, an elastic material such as a rubber so as to have a horizontal width extending over the whole range of the medium 11 in the X-axis direction. When one or both of the first transport roller 331 and second transport roller 332 are rotated, the transport belt 334 is rotated. The medium 11 is transported in the Y1 direction while in contact with the outer circumferential surface of the transport belt 334.

The electrifying section 34 electrifies the transport belt 334. The electrifying section 34 in the first embodiment has an electrifying roller 341 and a power supply 342. The rotational axis of the electrifying roller 341 is parallel to the X axis. The electrifying roller 341 is in contact with the outer circumferential surface of the transport belt 334. The power supply 342 applies a voltage to the electrifying roller 341. In electrification to the transport belt 334 by the electrifying section 34, either of direct current and alternate current may be used.

When the electrifying roller 341 is driven by the transport belt 334, positive charges are supplied from the electrifying roller 341 to the transport belt 334. Therefore, the outer circumferential surface of the transport belt 334 is positively charged. When induced polarization occurs on the medium 11 placed on the transport belt 334 in the electrified state, an electrostatic force is exerted between the transport belt 334 and the medium 11. That is, the medium 11 electrostatically adheres to the outer circumferential surface of the transport belt 334.

The first destaticizing device 35 is disposed between the electrifying section 34 and the liquid ejecting head 40 in the Y-axis direction. The first destaticizing device 35 has a destaticizing section 352 including a brush 351 protruding toward the transport belt 334 and also has an operating section 353 that adjusts contact pressure under which the destaticizing section 352 comes into contact with the transport belt 334 or medium 11. The brush 351 is a bundle of threads made of a material that can remove charges from the medium 11, such as a conductive nylon or another resin material.

The operating section 353 has a driving mechanism, such as a solenoid, used to move the destaticizing section 352. Specifically, the operating section 353 moves the destaticizing section 352 along the Z-axis as illustrated by the arrow in FIG. 2 to adjust the contact pressure under which the destaticizing section 352 comes into contact with the transport belt 334 or medium 11. When the medium 11 needs to be destaticized, the operating section 353 causes the destaticizing section 352 to come into contact with the transport belt 334 under contact pressure to the extent that the outer circumferential surface of the transport belt 334 warps. When the medium 11 does not need to be destaticized, the operating section 353 retracts the destaticizing section 352 to a position distant from the transport belt 334.

The first destaticizing device 35 is provided to remove paper dust attached to the front surface of a medium 11 with a brush 91 and thereby suppress a print failure caused when the paper dust adheres to the nozzle N. When a medium 11 is not electrostatically adhering to the outer circumferential surface of the transport belt 334, an electrostatic force with which the medium 11 adheres to the outer circumferential surface can be increased by removing charges on the front surface of the medium 11 with the first destaticizing device 35. However, the first destaticizing device 35 cannot completely remove charges on the medium 11 or transport belt 334. In a structure in which alternate current is used to electrify the transport belt 334, the first destaticizing device 35 may be eliminated.

The second destaticizing device 36 comes into contact with the outer circumferential surface of the transport belt 334 on the side opposite to the outer circumferential surface facing the medium 11 to remove charges on the transport belt 334. In a structure in which alternate current is used to electrify the transport belt 334, the second destaticizing device 36 may be eliminated.

The liquid ejecting head 40 ejects ink supplied from the liquid container 12 from a plurality of nozzles N to a medium 11 under control of the control unit 20. As illustrated in FIG. 1, the liquid ejecting head 40 in the first embodiment is a line head elongated in the X-axis direction. The plurality of nozzles N are distributed over the whole range of the medium 11 in the X-axis direction. The liquid ejecting head 40 ejects ink to the medium 11 along with the transport of the medium 11 by the transport mechanism 30, forming an image on the front surface of the medium 11.

In addition to the plurality of nozzles N, the liquid ejecting head 40 has a plurality of pressure chambers C and a plurality of driving elements E as illustrated in FIG. 2. The plurality of nozzles N are disposed in a surface of the liquid ejecting head 40, the surface facing the transport belt 334. That is, the medium 11 is transported in the Y1 direction between the liquid ejecting head 40 and the transport belt 334.

One pressure chamber C and one driving element E are provided for each nozzle N. The pressure chamber C is a space communicating with the nozzle N. Ink fed from the liquid container 12 is supplied to the plurality of pressure chambers C in the liquid ejecting head 40. The driving element E changes the pressure of ink in the pressure chamber C. An example used as the driving element E is a piezoelectric element that deforms a wall surface of the pressure chamber C to change the volume of the pressure chamber C. Another example is a heat-generating element that heats ink in the pressure chamber C to generate bubbles in the pressure chamber C. When the driving element E changes the pressure of ink in the pressure chamber C, the ink in the pressure chamber C is ejected from the nozzle N. The first embodiment assumes that ink in each nozzle N is negatively electrified.

As illustrated in FIG. 1, the control unit 20 supplies a plurality of signals, including a control signal S and a driving signal D, to the liquid ejecting head 40. The control signal S is a command given to each of the plurality of driving elements E as to whether to eject ink for a period T of a predetermined length of time (the period T will be referred to below as the unit period T). The driving signal D is a voltage signal that changes at a cycle with a length equal to the period T.

Figure 3:
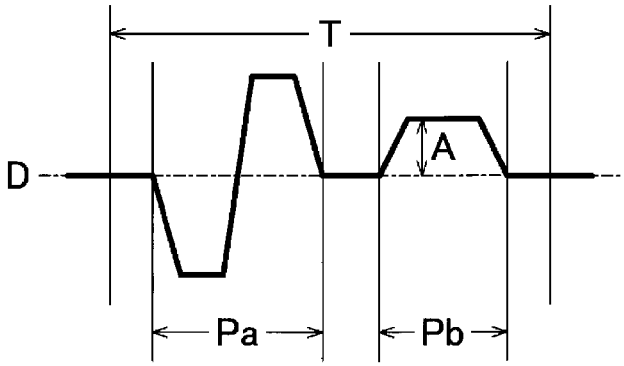
FIG. 3 is a waveform diagram of a driving signal.

FIG. 3 is a waveform diagram of the driving signal D. As illustrated in FIG. 3, the driving signal D in the first embodiment includes an ejection pulse Pa and a micro-vibration pulse Pb for each period T. The ejection pulse Pa drives the driving element E to eject ink from the nozzle N. That is, when the ejection pulse Pa is supplied to drive the driving element E, ink is ejected from the nozzle N corresponding to the driving element E.

The micro-vibration pulse Pb causes micro-vibration in ink in the pressure chamber C without causing ink to be ejected from the nozzle N. That is, when the micro-vibration pulse Pb is supplied to operate the driving element E, micro-vibration is generated in ink in the pressure chamber C corresponding to the driving element E. The micro-vibration pulse Pb is also referred to as the waveform that vibrates the meniscus of ink in the nozzle N. The intensity of micro-vibration generated in the pressure chamber C depends on the amplitude A of the micro-vibration pulse Pb. Specifically, the larger the amplitude A is, the more the intensity of micro-vibration is increased. The amplitude A is a range within which the voltage of the micro-vibration pulse Pb varies.

In the liquid ejecting apparatus 100A in the first embodiment, a plurality of nozzles N face the transport belt 334. Since ink in each nozzle N is negatively electrified as described above, charges on the transport belt 334 affect the meniscus of ink in the nozzle N in a state in which the transport belt 334 in the electrified state faces the plurality of nozzles N (this state will be referred to below as the first state). Specifically, the meniscus is drawn toward the transport belt 334 in the electrified state.

The amount of charges on the transport belt 334 varies depending on the environmental conditions including humidity. In a structure in which the intensity of micro-vibration is fixed, therefore, the degree of agitation by micro-vibration varies depending on the amount of charges on the transport belt 334. This leads the possibility that the agitation of ink by micro-vibration is not sufficient. In view of this situation, in the first embodiment, the intensity of micro-vibration to be applied to ink in each pressure chamber C is controlled according to the amount of charges on the transport belt 334.

Figure 4:
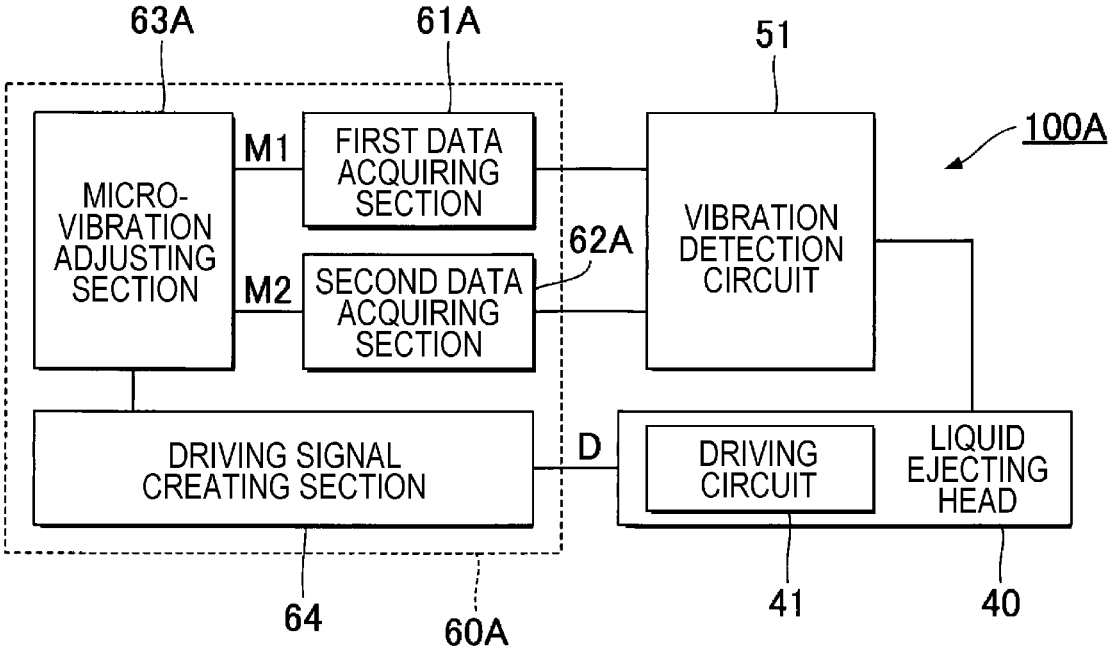
FIG. 4 is a block diagram illustrating the functional structure of the liquid ejecting apparatus.

FIG. 4 is a block diagram illustrating a functional structure in which the control unit 20 controls the intensity of micro-vibration. As illustrated in FIG. 4, the liquid ejecting apparatus 100A in the first embodiment has a driving circuit 41 and a vibration detection circuit 51. The driving circuit 41 is mounted in the liquid ejecting head 40. However, the driving circuit 41 may be mounted outside the liquid ejecting head 40.

The driving circuit 41 drives each of the plurality of driving elements E under control of the control unit 20. The driving circuit 41 in the first embodiment supplies the ejection pulse Pa or micro-vibration pulse Pb of the driving signal D to each of the plurality of driving elements E for each period T. Specifically, the driving circuit 41 supplies the ejection pulse Pa to a driving element E for which ejection of ink has been commanded by the control signal S, and supplies the micro-vibration pulse Pb to a driving element E for which non-ejection of ink has been commanded by the control signal S.

The vibration detection circuit 51 detects residual vibration in a particular pressure chamber C of the plurality of pressure chambers C. Residual vibration is variations in pressure remaining in ink in the pressure chamber C after an ejection pulse Pa has been supplied to the relevant driving element E. An electromotive force is generated when, for example, residual vibration in the pressure chamber C propagates to the relevant driving element E. The vibration detection circuit 51 detects the electromotive force generated in the driving element E as a voltage signal representing the waveform of the residual vibration. In the first state, there is a tendency that the larger the amount of charges on the transport belt 334 is, the more ink in the nozzle N is drawn to the transport belt 334, suppressing residual vibration. That is, the amplitude of residual vibration depends on the amount of charges on the transport belt 334. Therefore, the amplitude of residual vibration can be used as an index that indirectly represents the amount of charges on the transport belt 334.

When the control device 21 in the control unit 20 executes a program stored in the storage device 22, the control device 21 functions as a controller 60A in FIG. 4. The controller 60A controls the micro-vibration pulse Pb according to the amount of charges on the transport belt 334. That is, the micro-vibration pulse Pb is changed according to the amount of charges on the transport belt 334. As illustrated in FIG. 4, the controller 60A in the first embodiment has a first data acquiring section 61A, a second data acquiring section 62A, a micro-vibration adjusting section 63A, and a driving signal generation section 64. Part or all of the functions of the controller 60A may be implemented by special electronic circuits other than the control device 21. Alternatively, the functions of the controller 60A may be implemented by a plurality of apparatuses that are separately structured.

The first data acquiring section 61A acquires first data M1 related to the meniscus in the nozzle N in the first state. Specifically, first data M1 is data related to the state of the meniscus, which depends on the amount of charges on the transport belt 334. As described above, the property of residual vibration depends on the amount of charges on the transport belt 334. In view of this, the first data acquiring section 61A in the first embodiment acquires first data M1 representing the property of residual vibration detected by the vibration detection circuit 51 in the first state. Specifically, first data M1 represents the amplitude of residual vibration in the first state. For example, the amplitude of residual vibration detected by the vibration detection circuit 51 for a particular pressure chamber C of the plurality of pressure chambers C is presented by first data M1. There is a tendency that the larger the amount of charges on the transport belt 334 is, the smaller the amplitude, represented by first data M1, of residual vibration is. As will be understood from the above, first data M1 can also be said to be data that indirectly represents the amount of charges on the transport belt 334.

The second data acquiring section 62A acquires second data M2 related to the meniscus in the nozzle N in a state in which the transport belt 334 in the electrified state does not face the plurality of nozzles N (this state will be referred to below as the second state). In the second state, the transport belt 334 is not electrified. Specifically, a state in which the electrifying section 34 does not operate is equivalent to the second state. Second data M2 is reference data taken as a basis for the meniscus's state represented by first data M1.

The second data acquiring section 62A in the first embodiment acquires second data M2 representing the property of residual vibration detected by the vibration detection circuit 51 in the second state. Specifically, second data M2 represents the amplitude of residual vibration in the second state. For example, the amplitude of residual vibration detected by the vibration detection circuit 51 for a particular pressure chamber C of the plurality of pressure chambers C is presented by second data M2.

The driving signal generation section 64 generates a driving signal D that includes an ejection pulse Pa and micro-vibration pulse Pb for each period T. The driving signal D generated by the driving signal generation section 64 is supplied to the driving circuit 41 together with a separately generated control signal S.

The micro-vibration adjusting section 63A controls the micro-vibration pulse Pb in the driving signal D generated by the driving signal generation section 64. Specifically, the micro-vibration adjusting section 63A in the first embodiment can change the amplitude A of the micro-vibration pulse Pb. Since the intensity of micro-vibration generated in the pressure chamber C depends on the amplitude A of the micro-vibration pulse Pb as described above, the micro-vibration adjusting section 63A can also be said to be an element that controls the intensity of micro-vibration generated in the pressure chamber C.

The micro-vibration adjusting section 63A in the first embodiment controls the micro-vibration pulse Pb according to first data M1 acquired by the first data acquiring section 61A and second data M2 acquired by the second data acquiring section 62A. Specifically, the micro-vibration adjusting section 63A controls the amplitude A of the micro-vibration pulse Pb according to the result of a comparison between first data M1 and second data M2.

Figure 5:
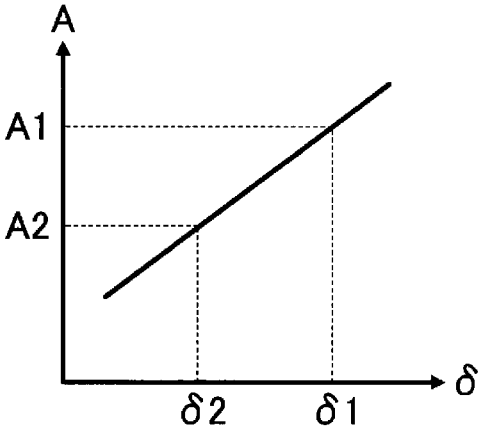
FIG. 5 is a graph representing a relationship between a difference in the amplitude of residual vibration and the amplitude of a micro-vibration pulse.

Attention will be paid to a difference δ in amplitude between residual vibration represented by first data M1 and residual vibration represented by second data M2. There is a tendency that the larger the amount of charges on the transport belt 334 is, the larger the difference δ between first data M1 and second data M2 is. In view of this tendency, the micro-vibration adjusting section 63A in the first embodiment raises the intensity of micro-vibration by increasing the amplitude A of the micro-vibration pulse Pb so that the larger the difference δ is, the larger the amplitude A is. FIG. 5 illustrates a relationship between the difference δ and the amplitude A of the micro-vibration pulse Pb. Attention will be paid to a first value δ1 and a second value δ2 that the difference δ can take, as illustrated in FIG. 5. The first value δ1 exceeds the second value δ2 (δ1>δ2). As will be understood from FIG. 5, the amplitude A1 of the micro-vibration pulse Pb when the difference δ is the first value δ1 is larger than the amplitude A2 of the micro-vibration pulse Pb when the difference δ is the second value δ2 (A1>A2).

Figure 6:
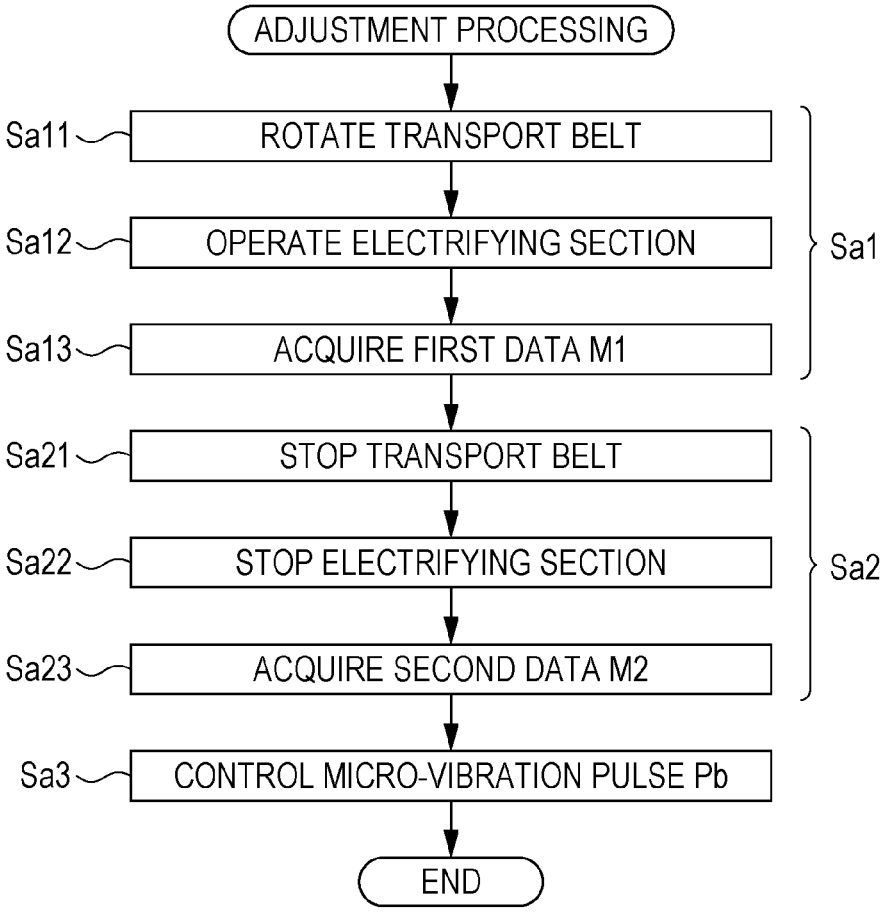
FIG. 6 is a flowchart exemplifying a specific procedure in adjustment processing.

FIG. 6 is a flowchart exemplifying a specific procedure in processing in which the controller 60A adjusts the intensity of micro-vibration (this processing will be referred to below as adjustment processing). Adjustment processing in FIG. 6 is executed, for example, immediately before an operation to form an image on a medium 11 starts (this operation will be referred to below as the ejection operation).

When adjustment processing starts, the first data acquiring section 61A acquires first data M1 by a procedure Sa1 described below. First, the first data acquiring section 61A rotates the transport belt 334 (Sa11), after which the first data acquiring section 61A operates the electrifying section 34 (Sa12). That is, the transport belt 334 in the electrified state shifts to the first state in which the transport belt 334 faces the plurality of nozzles N. As will be understood from the above, the first state can also be said to be a state in which the transport belt 334 is rotating. During the execution of adjustment processing, the supply mechanism 31 does not transport a medium 11. Therefore, the transport belt 334 rotates without supporting a medium 11. The sequence of the starting of the rotation of the transport belt 334 (Sa11) and the starting of the operation of the electrifying section 34 (Sa12) may be reversed. Alternately, the rotation of the transport belt 334 (Sa11) and the operation of the electrifying section 34 (Sa12) may be concurrently started.

The first data acquiring section 61A acquires first data M1 related to the state of the meniscus in the first state (Sa13). Specifically, the first data acquiring section 61A controls the driving circuit 41 and supplies an ejection pulse Pa to the driving element E. The first data acquiring section 61A analyzes residual vibration detected by the vibration detection circuit 51 after the supply of the ejection pulse Pa, and generates first data M1 representing the amplitude of the residual vibration.

The second data acquiring section 62A acquires second data M2 by a procedure Sa2 described below. First, the second data acquiring section 62A stops the rotation of the transport belt 334 (Sa21), after which the second data acquiring section 62A stops the operation of the electrifying section 34 (Sa22). That is, the transport belt 334 in the electrified state shifts to the second state in which the transport belt 334 does not face the plurality of nozzles N. As will be understood from the above, the second state can also be said to be a state in which the transport belt 334 is not rotating. The sequence of the stopping of the rotation of the transport belt 334 (Sa21) and the stopping of the operation of the electrifying section 34 (Sa22) may be reversed. Alternately, the rotation of the transport belt 334 (Sa21) and the operation of the electrifying section 34 (Sa22) may be concurrently stopped.

The second data acquiring section 62A acquires second data M2 related to the state of the meniscus in the second state described above (Sa23). Specifically, the second data acquiring section 62A controls the driving circuit 41 and supplies an ejection pulse Pa to the driving element E. The second data acquiring section 62A analyzes residual vibration detected by the vibration detection circuit 51 after the supply of the ejection pulse Pa, and generates second data M2 representing the amplitude of the residual vibration. In the above description, after first data M1 had been acquired (Sa1), second data M2 has been acquired (Sa2). However, after second data M2 has been acquired (Sa2), first data M1 may be acquired (Sa1).

The micro-vibration adjusting section 63A sets a micro-vibration pulse Pb according to the result of a comparison between the first data M1 and the second data M2 (Sa3). Specifically, the micro-vibration adjusting section 63A calculates the difference δ between the first data M1 and the second data M2, and sets the amplitude A of the micro-vibration pulse Pb according to the difference δ. In the ejection operation after the execution of adjustment processing exemplified above, the driving signal generation section 64 generates a driving signal D including a micro-vibration pulse Pb having the amplitude A set by the micro-vibration adjusting section 63A.

As described above, in the first embodiment, the micro-vibration pulse Pb is controlled according to first data M1 related to the state of the meniscus in the first state, so even when the state of the meniscus is affected by charges on the transport belt 334, ink in the pressure chamber C can be appropriately agitated by micro-vibration. In the first embodiment, the micro-vibration pulse Pb is controlled, particularly according to the result of a comparison between first data M1 in the first state in which charges on the transport belt 334 affects the meniscus and second data M2 in the second state in which charges on the transport belt 334 do not affect the meniscus. Therefore, ink in the pressure chamber C can be sufficiently agitated by micro-vibration.

Also in the first embodiment, the micro-vibration pulse Pb is controlled according to first data M1 representing the property of residual vibration in the pressure chamber C. Therefore, ink in the pressure chamber C can be sufficiently agitated according to the amount of charges on the transport belt 334, without a need for a structure for directly detecting the amount of charges on the transport belt 334.

It can be considered that the amplitude A of the micro-vibration pulse Pb is set to a value large enough to reliably agitate ink even when the amount of charges assumed to be accumulated on the transport belt 334 is maximized. However, when the intensity of micro-vibration is excessively large, the meniscus may be destroyed. Alternatively, contrary to the intended purpose of generating micro-vibration, that is, reducing the viscosity of ink, an increase in viscosity may proceed. In the first embodiment, however, since the intensity of micro-vibration is adjusted according to the amount of charges on the transport belt 334, the possibility that excessive micro-vibration is given is reduced. This is advantageous in that the breakage of the meniscus or the progress of an increase in the viscosity of ink can be suppressed.

Although, in the first embodiment, the micro-vibration pulse Pb has been controlled according to the micro-vibration in a single pressure chamber C, any number of pressure chambers C may be used to control the micro-vibration pulse Pb. For example, the average of amplitudes of residual vibration detected by the vibration detection circuit 51 for a plurality of pressure chambers C may be used as first data M1 or second data M2. In the first embodiment, the driving element E used for an injection operation has also been used to detect residual vibration, a detection element used only for the detection of residual vibration may be disposed separately from the driving element E used for an injection operation.

Although, in the first embodiment, second data M2 has been generated from residual vibration detected by the vibration detection circuit 51, second data M2 may be stored in advance in the storage device 22 and the second data acquiring section 62A may acquire the second data M2. For example, second data M2 representing the amplitude of standard residual vibration in the second state is stored in advance in the storage device 22. In this structure, generation of second data M2 in the procedure Sa2 in adjustment processing is not necessary. This is advantageous in that adjustment processing is simplified. In the first embodiment in which second data M2 is generated from residual vibration detected by the vibration detection circuit 51, the actual state of ink is reflected in second data M2. Therefore, the outstanding effect of appropriately agitating ink in the pressure chamber C by micro-vibration is obtained, unlike the structure in which second data M2 is stored in the storage device 22 in advance.

Although, in the first embodiment, residual vibration after the supply of an ejection pulse Pa has been detected, the method of generating residual vibration in the pressure chamber C is not limited to the supply of an ejection pulse Pa. For example, residual vibration may be generated by supplying, to the driving element E, a pulse used for detection without causing ink to be ejected from the nozzle N. This structure is advantageous in that the amount of ink consumption is reduced and the contamination of the transport belt 334 due to the adhesion of ink is suppressed.

B: Second Embodiment

A second embodiment will be described. In the aspects exemplified below, elements having functions similar to functions in the first embodiment will be denoted by the relevant reference numerals used in the first embodiment and detailed descriptions of these elements will be appropriately omitted.

Figure 7:
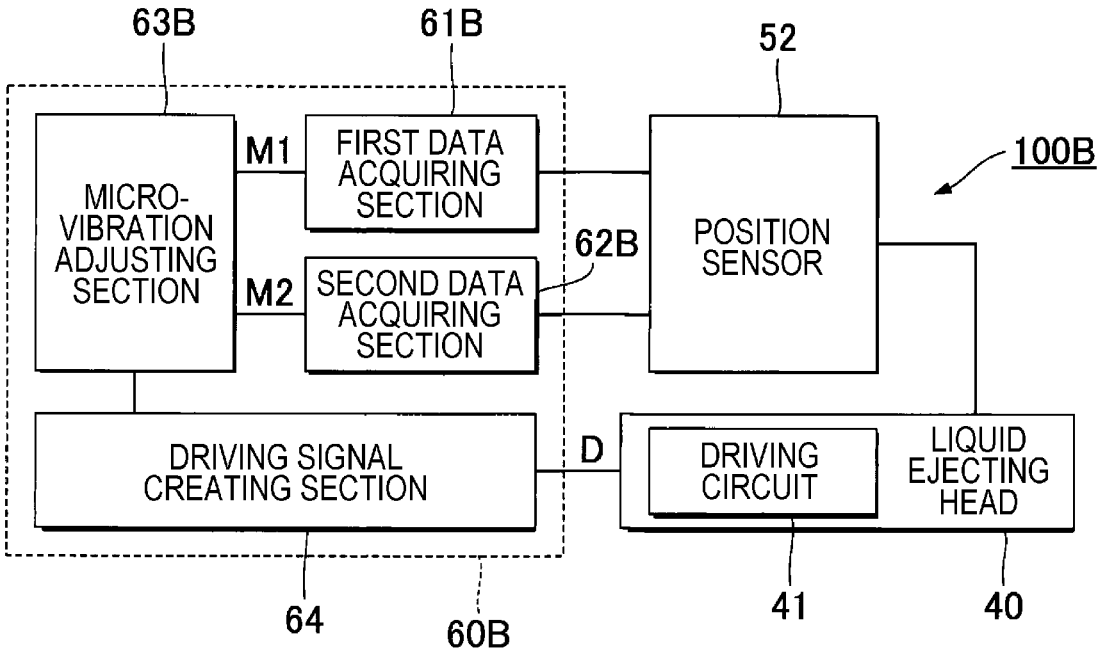
FIG. 7 is a block diagram illustrating the functional structure of a liquid ejecting apparatus according to a second embodiment.

FIG. 7 is a block diagram illustrating the functional structure of a liquid ejecting apparatus 100B according to the second embodiment. As illustrated in FIG. 7, the liquid ejecting apparatus 100B in the second embodiment has a position sensor 52 instead of the vibration detection circuit 51 in the first embodiment. The structures of the liquid ejecting head 40 and transport mechanism 30 are similar to those in the first embodiment.

The position sensor 52 detects the position of the meniscus in the Z-axis direction for a particular nozzle N of a plurality of nozzles N (the position will be referred to below as the meniscus position). An example preferably used as the position sensor 52 is an optical sensor that includes a light emitting element that emits light such as laser light to the meniscus and a light receiving element that receives light reflected on the meniscus. Another example usable as the position sensor 52 is an ultrasonic sensor that includes including an ultrasonic element that transmits an ultrasonic wave to the meniscus and receives an ultrasonic wave reflected on the meniscus.

The meniscus position detected by the position sensor 52 depends on the amount of charges on the transport belt 334. Specifically, there is a tendency that the larger the amount of charges on the transport belt 334 is, the closer the meniscus position is to the transport belt 334. That is, the meniscus position depends on the amount of charges on the transport belt 334. Therefore, the meniscus position detected by the position sensor 52 can be used as an index that indirectly represents the amount of charges on the transport belt 334.

When the control device 21 in the control unit 20 in the second embodiment executes a program stored in the storage device 22, the control device 21 functions as a controller 60B in FIG. 7. As with the controller 60A in the first embodiment, the controller 60B controls the micro-vibration pulse Pb according to the amount of charges on the transport belt 334. In addition to a driving signal generation section 64 similar to that in the first embodiment, the controller 60B has a first data acquiring section 61B, a second data acquiring section 62B, and a micro-vibration adjusting section 63B.

The first data acquiring section 61B acquires first data M1 representing the meniscus position detected by the position sensor 52 in the first state (Sa1). That is, first data M1 is data related to the state of the meniscus in the first state, as in the first embodiment. The second data acquiring section 62B acquires second data M2 representing the meniscus position detected by the position sensor 52 in the second state (Sa2). That is, second data M2 is data related to the state of the meniscus in the second state, as in the first embodiment. First data M1 and second data M2 each can also be said to be data that indirectly represents the amount of charges on the transport belt 334.

As with the micro-vibration adjusting section 63A in the first embodiment, the micro-vibration adjusting section 63B controls the micro-vibration pulse Pb according to the result of a comparison between first data M1 and second data M2 (Sa3). Specifically, the micro-vibration adjusting section 63B increases the amplitude A of the micro-vibration pulse Pb so that the larger the difference δ between the meniscus position represented by first data M1 and the meniscus position represented by second data M2, the larger the amplitude of A is, as exemplified in FIG. 5.

In the second embodiment as well, an effect is obtained as in the first embodiment. Since, in the second embodiment, the micro-vibration pulse Pb is controlled according to first data M1 or second data M2 that represents the meniscus position detected by the position sensor 52, ink in the pressure chamber C can be appropriately agitated according to the actual effect of charges on the transport belt 334 on the meniscus.

Although, in the above description, the micro-vibration pulse Pb has been controlled according to the meniscus position in a single nozzle N, any number of nozzles N may be used to control the micro-vibration pulse Pb. For example, the average of meniscus positions detected by the position sensor 52 for a plurality of nozzles N may be used as first data M1 or second data M2.

Although, in the second embodiment, second data M2 representing the meniscus position detected by the position sensor 52 has been generated, second data M2 may be stored in advance in the storage device 22 and the second data acquiring section 62B may acquire the second data M2. For example, second data M2 representing a standard meniscus position in the second state is stored in advance in the storage device 22. In this structure, generation of second data M2 in the procedure Sa2 in adjustment processing is not necessary. This is advantageous in that adjustment processing is simplified. In the second embodiment in which second data M2 representing the meniscus position detected by the position sensor 52 is generated, the actual state of ink is reflected in second data M2. Therefore, the outstanding effect of appropriately agitating ink in the pressure chamber C by micro-vibration is obtained unlike the structure in which second data M2 is stored in advance in the storage device 22.

In the above description, after first data M1 had been acquired (Sa1), second data M2 has been acquired (Sa2). However, after second data M2 has been acquired (Sa2), first data M1 may be acquired (Sa1).

C: Third Embodiment

Figure 8:
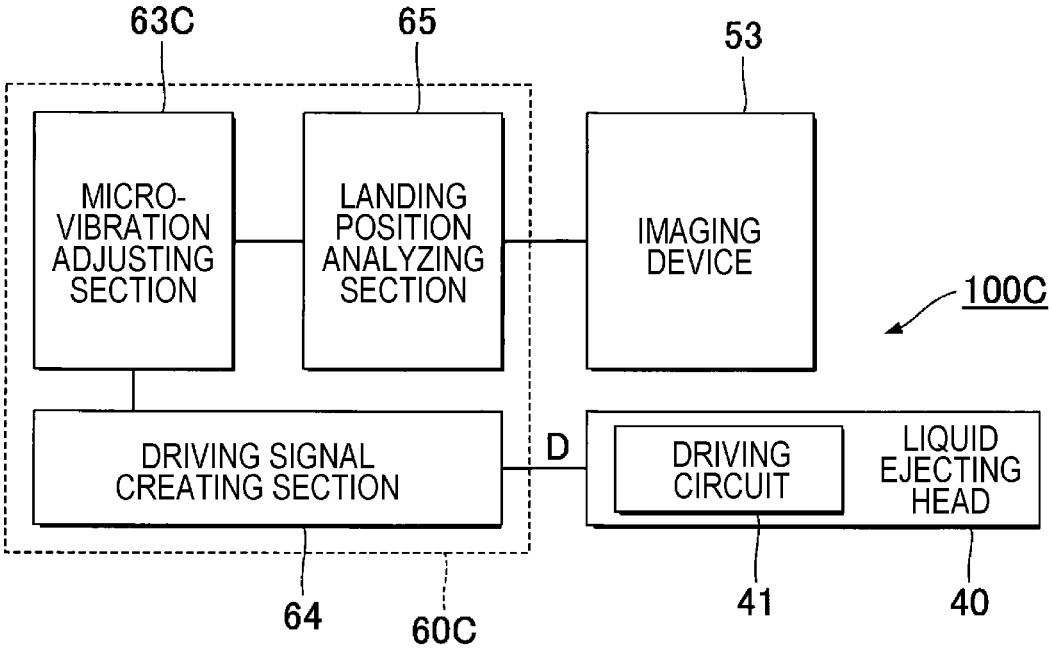
FIG. 8 is a block diagram illustrating the functional structure of a liquid ejecting apparatus according to a third embodiment.

FIG. 8 is a block diagram illustrating the functional structure of a liquid ejecting apparatus 100C according to a third embodiment. As illustrated in FIG. 8, the liquid ejecting apparatus 100C in the third embodiment has an imaging device 53 instead of the vibration detection circuit 51 in the first embodiment. The imaging device 53 is a sensor that photographs the front surface of a medium 11. Specifically, the imaging device 53 captures an image formed on the front surface of a medium 11 with ink landed from the liquid ejecting head 40. The structures of the liquid ejecting head 40 and transport mechanism 30 in the third embodiment are similar to those in the first embodiment.

When the control device 21 in the control unit 20 in the third embodiment executes a program stored in the storage device 22, the control device 21 functions as a controller 60C in FIG. 8. As with the controller 60A in the first embodiment, the controller 60C controls the micro-vibration pulse Pb according to the amount of charges on the transport belt 334. In addition to a driving signal generation section 64 similar to that in the first embodiment, the controller 60C has a landing position analyzing section 65 and a micro-vibration adjusting section 63C. The landing position analyzing section 65 analyzes an image captured by the imaging device 53 and identifies a position at which ink ejected from the liquid ejecting head 40 has landed on the front surface of the medium 11 (this position will be referred to as the landing position).

Figure 9:
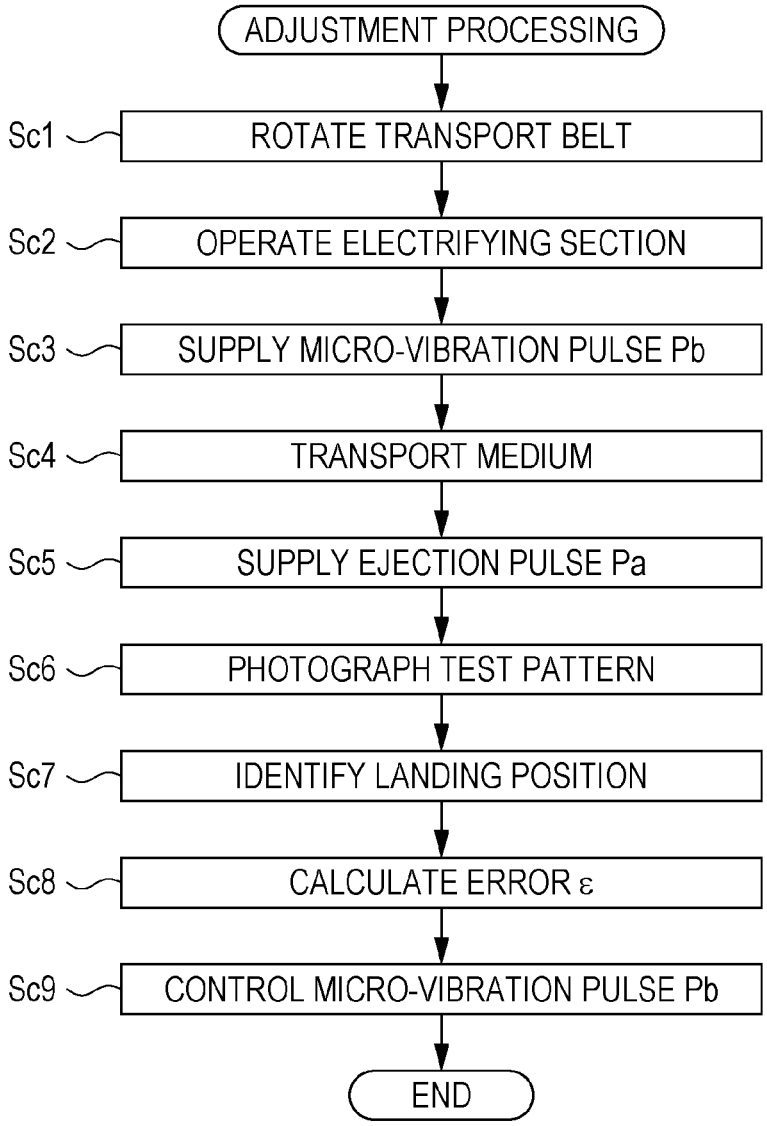
FIG. 9 is a flowchart exemplifying a specific procedure in adjustment processing in the third embodiment.

FIG. 9 is a flowchart exemplifying a specific procedure in adjustment processing in the third embodiment. Adjustment processing is executed before an ejection operation is started, as in the first embodiment. When adjustment processing is started, the controller 60C rotates the transport belt 334 (Sc1) and operates the electrifying section 34 (Sc2). The controller 60C controls the driving circuit 41 to supply a micro-vibration pulse Pb to each driving element E (Sc3). That is, an operation to generate micro-vibration in each pressure chamber C is performed in a state in which the transport belt 334 in the electrified state faces the plurality of nozzles N (this operation will be referred to below as the preparation operation). The preparation operation is continued for a predetermined length of time while the transport belt 334 in the electrified state is being rotated. During the execution of the preparation operation, the transport mechanism 30 does not transport a medium 11.

After the preparation operation has been continued for the predetermined length of time, the controller 60C causes the transport mechanism 30 to start to transport a medium 11 while keeping the operation of the electrifying section 34 (Sc4). The controller 60C also controls the driving circuit 41 to have it supply an ejection pulse Pa to each driving element E so that ink is ejected from the plurality of nozzles N to the medium 11 (Sc5). Specifically, the controller 60C controls the driving circuit 41 so that a predetermined pattern (referred to below as a test pattern) is formed on the front surface of the medium 11. The test pattern is, for example, a geometric image such as ruled lines parallel to the X-axis.

The controller 60C causes the imaging device 53 to photograph the test pattern formed on the medium 11 (Sc6). The landing position analyzing section 65 analyzes the image captured by the imaging device 53 and identifies a landing position for each nozzle N (Sc7). The landing position analyzing section 65 also calculates error ε between a target position and the landing position identified from the image (Sc8). For example, the difference between the target position and the landing position of ink ejected from a particular nozzle N is calculated as error ε. The average of values obtained by calculating the difference between the target position and the landing position for a plurality of nozzles N may be calculated as error ε.

The micro-vibration adjusting section 63C adjusts the micro-vibration pulse Pb according to error 8 calculated by the landing position analyzing section 65 (Sc9). Large error ε in the landing position indicates that micro-vibration is insufficient to the amount of charges on the transport belt 334. In view of this, the micro-vibration adjusting section 63C increases the amplitude A of the micro-vibration pulse Pb so that the larger error ε is, the larger the amplitude A is. As will be understood from the above, the controller 60C in the third embodiment controls the micro-vibration pulse Pb according to the landing position on the medium 11. The driving signal generation section 64 generates a driving signal D including a micro-vibration pulse Pb adjusted in adjustment processing exemplified above.

As will be understood from the above, since, in the third embodiment, the micro-vibration pulse Pb is controlled according to the landing position of ink on the medium 11, ink in the pressure chamber C can be appropriately agitated by micro-vibration even when the state of the meniscus is affected by charges on the transport belt 334.

Figure 10:
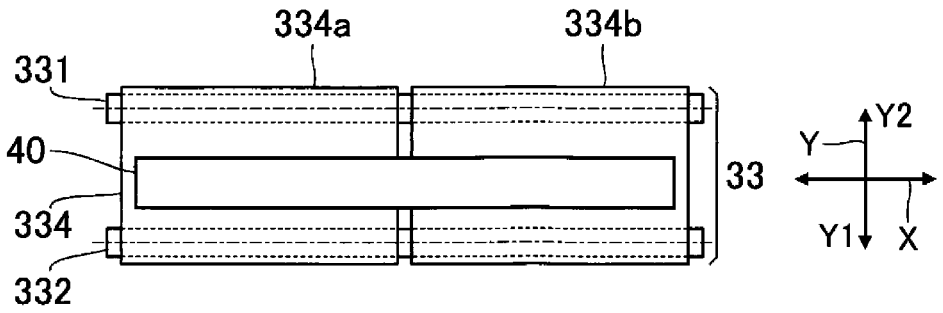
FIG. 10 is a plan view of a transfer belt in a variation in the third embodiment.

As illustrated in FIG. 10, the transport belt 334 used in adjustment processing may be divided into a first portion 334*a* and a second portion 334*b* along the X-axis. In the preparation operation in which micro-vibration is given to each pressure chamber C, the first portion 334*a* of the transport belt 334 is rotated and its second portion 334*b* is not rotated. Also in the preparation operation, the first portion 334*a* is electrified and the second portion 334*b* is not electrified. After the execution of the preparation operation, the controller 60C causes ink to be ejected from the plurality of nozzles N to the medium 11. The landing position analyzing section 65 analyzes the image captured by the imaging device 53 and identifies the landing position of ink ejected from each nozzle N. Specifically, the landing position analyzing section 65 calculates error c between the landing positions of ink ejected from nozzles N corresponding to the first portion 334*a* and the landing positions of ink ejected from nozzles N corresponding to the second portion 334*b*. An operation performed by the micro-vibration adjusting section 63C to control the micro-vibration pulse Pb according to this error c in landing positions is similar to the operation, described above, performed by the micro-vibration adjusting section 63C to control the micro-vibration pulse Pb according to error c calculated by the landing position analyzing section 65.

In the third embodiment, it is preferable to execute a maintenance operation such as flushing in which ink that does not contribute the forming of an image is forcibly ejected from each nozzle N or cleaning in which ink is discharged from a plurality of nozzles N by suction or pressurization before a micro-vibration pulse Pb is supplied to each driving element E in Sc3. When a maintenance operation is executed, calculation error in error c can be reduced because of suppression of landing position deviation caused on the test pattern due to an increase in the viscosity of ink that has been continued from before adjustment processing.

D: Fourth Embodiment

Figure 11:
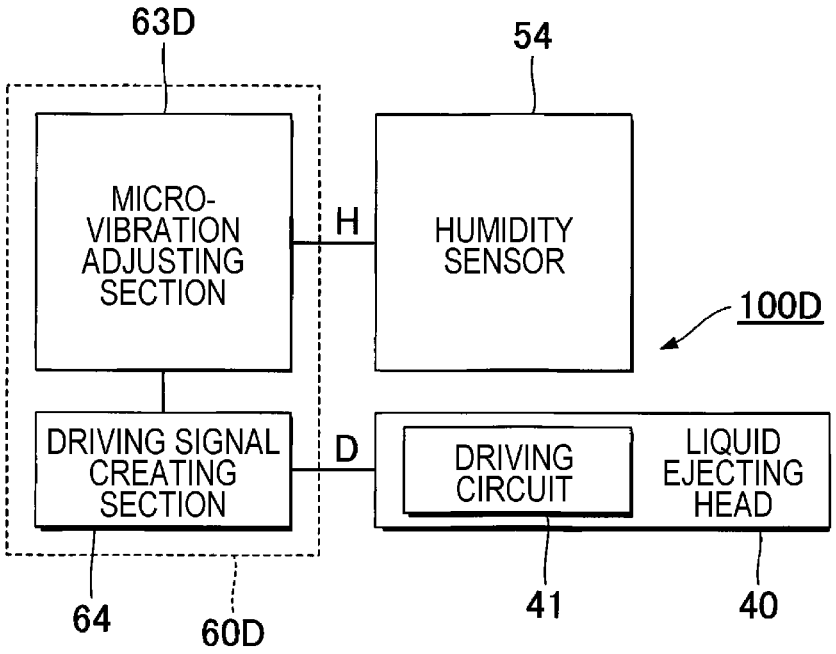
FIG. 11 is a block diagram illustrating the functional structure of a liquid ejecting apparatus according to a fourth embodiment.

FIG. 11 is a block diagram illustrating the functional structure of a liquid ejecting apparatus 100D according to a fourth embodiment. As illustrated in FIG. 11, the liquid ejecting apparatus 100D in the fourth embodiment has a humidity sensor 54 instead of the vibration detection circuit 51 in the first embodiment. The structures of the liquid ejecting head 40 and transport mechanism 30 are similar to those in the first embodiment. The humidity sensor 54 detects humidity H in the environment in which the liquid ejecting apparatus 100D is used. Specifically, the humidity sensor 54 detects humidity H in the cabinet of the liquid ejecting apparatus 100D. The humidity sensor 54 may detect humidity H in a space outside the liquid ejecting apparatus 100D.

When the control device 21 in the control unit 20 in the fourth embodiment executes a program stored in the storage device 22, the control device 21 functions as a controller 60D in FIG. 11. As with the controller 60A in the first embodiment, the controller 60D controls the micro-vibration pulse Pb according to the amount of charges on the transport belt 334. The amount of charges on the transport belt 334 depends on humidity H. Specifically, the lower humidity H is, the more the amount of charges on the transport belt 334 is increased. In view of this, the controller 60D in the fourth embodiment controls the micro-vibration pulse Pb according to humidity H detected by the humidity sensor 54. In addition to a driving signal generation section 64 similar to that in the first embodiment, the controller 60D has a micro-vibration adjusting section 63D.

Figure 12:
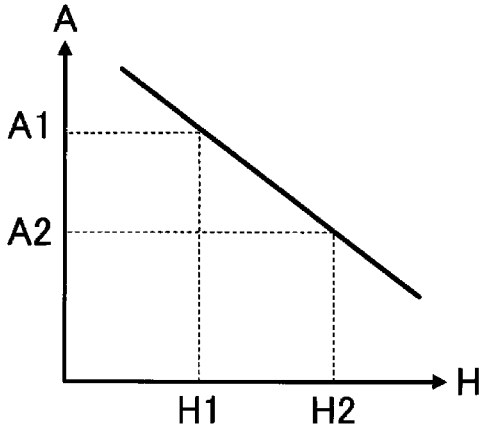
FIG. 12 is a graph representing a relationship between humidity and the amplitude of a micro-vibration pulse.

The micro-vibration adjusting section 63D controls the amplitude A of the micro-vibration pulse Pb according to humidity H detected by the humidity sensor 54. There is a tendency that the lower humidity H is, the more the amount of charges on the transport belt 334 is increased, and there is also a tendency that the more the amount of charges on the transport belt 334 is, the harder ink in the pressure chamber C is to agitate by micro-vibration. In view of this, the micro-vibration adjusting section 63D in the fourth embodiment raises the intensity of micro-vibration by increasing the amplitude A of the micro-vibration pulse Pb so that the lower humidity H detected by the humidity sensor 54 is, the larger the amplitude A is. FIG. 12 illustrates a relationship between humidity H and the amplitude A of the micro-vibration pulse Pb. Attention will be paid to a first value H1 and second value H2 that humidity H can take, as illustrated in FIG. 12. The first value H1 is lower than the second value H2 (H1<H2). As will be understood from FIG. 11, the amplitude A1 of the micro-vibration pulse Pb when the humidity H is the first value H1 is larger than the amplitude A2 of the micro-vibration pulse Pb when the humidity H is the second value H2 (A1>A2).

Figure 13:
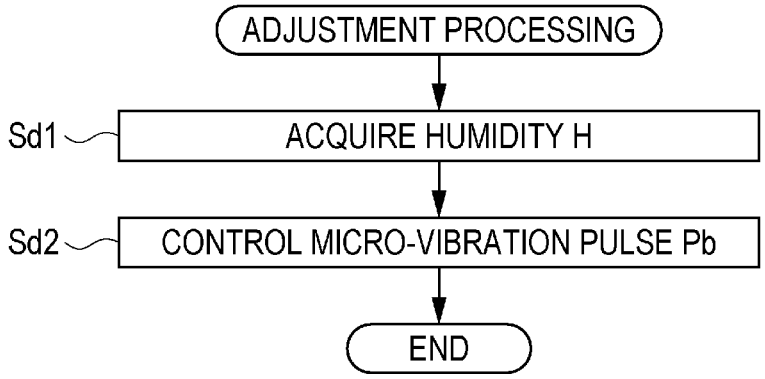
FIG. 13 is a flowchart exemplifying a specific procedure in adjustment processing in the fourth embodiment.

FIG. 13 is a flowchart exemplifying a specific procedure in adjustment processing in the fourth embodiment. Adjustment processing is executed before an ejection operation is started, as in the first embodiment. When adjustment processing is started, the micro-vibration adjusting section 63D acquires humidity H detected by the humidity sensor 54 (Sd1). The micro-vibration adjusting section 63D then sets the amplitude A of the micro-vibration pulse Pb according to the humidity H (Sd2). In an ejection operation after the execution of adjustment processing exemplified above, the driving signal generation section 64 generates a driving signal D including a micro-vibration pulse Pb having the amplitude A set by the micro-vibration adjusting section 63D.

As described above, in the fourth embodiment, the micro-vibration pulse Pb is controlled according to humidity H detected by the humidity sensor 54, so ink in the pressure chamber C can be appropriately agitated by micro-vibration even when the state of the meniscus is affected by charges on the transport belt 334. Particularly, in the fourth embodiment, the amplitude A1 of the micro-vibration pulse Pb when humidity H is the first value H1 is larger the amplitude A2 of the micro-vibration pulse Pb when humidity H is the second value H2. This is advantageous in that ink in the pressure chamber C can be appropriately agitated by micro-vibration in spite of the tendency that the lower humidity H is, the more likely the transport belt 334 is to be electrified.

As described above, in the fourth embodiment, the amplitude A1 of the micro-vibration pulse Pb when humidity H is the first value H1 is larger the amplitude A2 of the micro-vibration pulse Pb when humidity H is the second value H2. Therefore, ink in the pressure chamber C can be appropriately agitated by micro-vibration in spite of the tendency that the lower humidity H is, the more the amount of charges on the transport belt 334 is increased.

E: Fifth Embodiment

Figure 14:
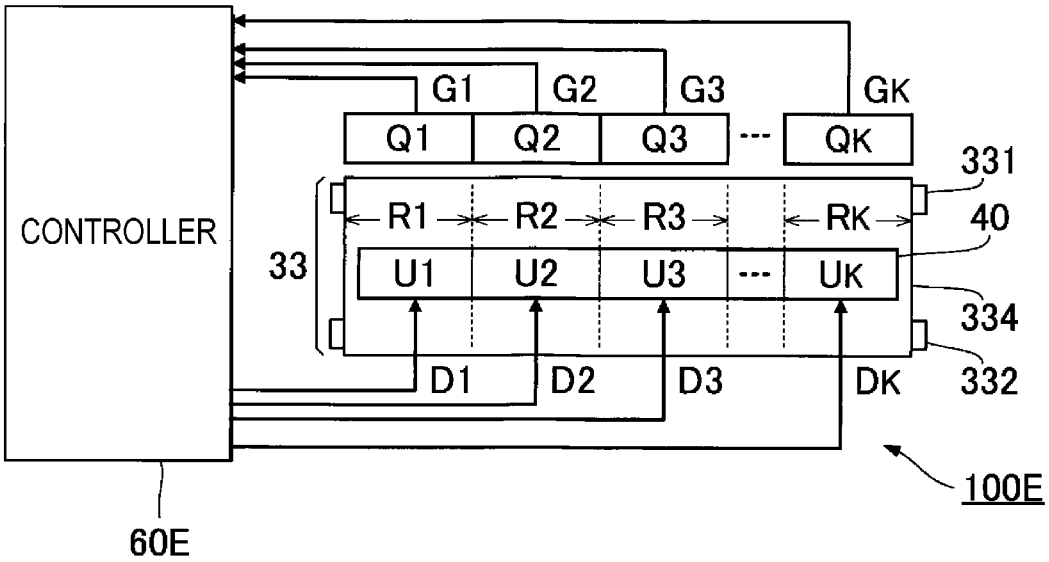
FIG. 14 is a block diagram illustrating the functional structure of a liquid ejecting apparatus according to a fifth embodiment.

FIG. 14 is a block diagram illustrating the functional structure of a liquid ejecting apparatus 100E according to a fifth embodiment. As illustrated in FIG. 14, the liquid ejecting apparatus 100E in the fifth embodiment has K electrifying sensors Q1 to QK (K is a natural number equal to or larger than 1) instead of the vibration detection circuit 51 in the first embodiment.

As illustrated in FIG. 14, the outer circumferential surface of the transport belt 334 is divided into K regions R1 to RK along the X-axis. Each electrifying sensor Qk (k is any value from 1 to K) faces one region Rk of the K regions R1 to RK. That is, the K electrifying sensors Q1 to QK are disposed at different positions on the transport belt 334 in the X-axis direction. The positions of the K electrifying sensors Q1 to QK are also between the liquid ejecting head 40 and the first destaticizing device 35 in the Y-axis direction. Each electrifying sensor Qk detects the amount Gk of charges in a region Rk on the transport belt 334. That is, the amount Gk of charges is detected for each of the different K regions R1 to RK on the X-axis on the outer circumferential surface of the transport belt 334. A non-contact type of surface potential measurement instrument, for example, is used as an electrifying sensor Qk.

The liquid ejecting head 40 in the fifth embodiment has K portions (referred to below as unit head portions) U1 to UK arranged along the X-axis. Each of the K unit head portions U1 to UK has a plurality of nozzles N, a plurality of pressure chambers C, and a plurality of driving elements E. The plurality of nozzles N in each unit head portion Uk face a region Rk on the transport belt 334. That is, the K unit head portions U1 to UK face different regions Rk on the transport belt 334. A separate driving signal Dk is supplied from the control unit 20 to each of the K unit head portions U1 to UK. Each driving signal Dk includes an ejection pulse Pa and a micro-vibration pulse Pb as with the driving signal D in the first embodiment.

When the control device 21 in the control unit 20 in the fifth embodiment executes a program stored in the storage device 22, the control device 21 functions as a controller 60E in FIG. 14. The controller 60E generates K driving signals D1 to DK. The controller 60E also executes adjustment processing to adjust the intensity of micro-vibration. In adjustment processing, the controller 60E controls the amplitude A of the micro-vibration pulse Pb in a driving signal Dk according to the amount Gk of charges detected by an electrifying sensor Qk. Specifically, the controller 60E increases the amplitude A of the micro-vibration pulse Pb in a driving signal Dk so that the larger the amount Gk of charges is, the larger the amplitude A is. That is, the larger the amount Gk of charges on the transport belt 334 is, the more the intensity of micro-vibration generated in each pressure chamber C in the unit head portion Uk is increased.

As described above, in the fifth embodiment, the intensity of micro-vibration is adjusted according to the actual amount Gk of charges on the transport belt 334, so ink in the pressure chamber C can be appropriately agitated by micro-vibration even when the state of the meniscus is affected by charges on the transport belt 334. Also in the fifth embodiment, the micro-vibration pulse Pb of a driving signal Dk is controlled according to the amount Gk of charges in each of the K regions R1 to RK on the transport belt 334. This is advantageous in that ink in the pressure chamber C can be appropriately agitated by micro-vibration even when the amount Gk of charges on the transport belt 334 in its width direction varies.

F: Variations

The embodiments described above can be varied in various ways. Aspects of specific variations that can be applied to the above embodiments will be exemplified below. Any two or more aspects selected from the exemplary examples described below can be combined within a range in which any mutual contradiction does not occur.

(1) There is a tendency that the higher the rotational speed of the transport belt 334 is, the more charges on the transport belt 334 affect the meniscus. In view of this, in the above embodiments, a controller 60, correctively referring to the controllers 60A, 60B, 60C, 60D and 60E, may control the micro-vibration pulse Pb according to the rotational speed of the transport belt 334. For example, the controller 60 raises the intensity of micro-vibration by increasing the amplitude A of the micro-vibration pulse Pb so that the higher the rotational speed of the transport belt 334 is, the larger the amplitude A is. In this structure, it is possible to generate, in the pressure chamber C, micro-vibration with intensity appropriate to the rotational speed of the transport belt 334.

Figure 15:
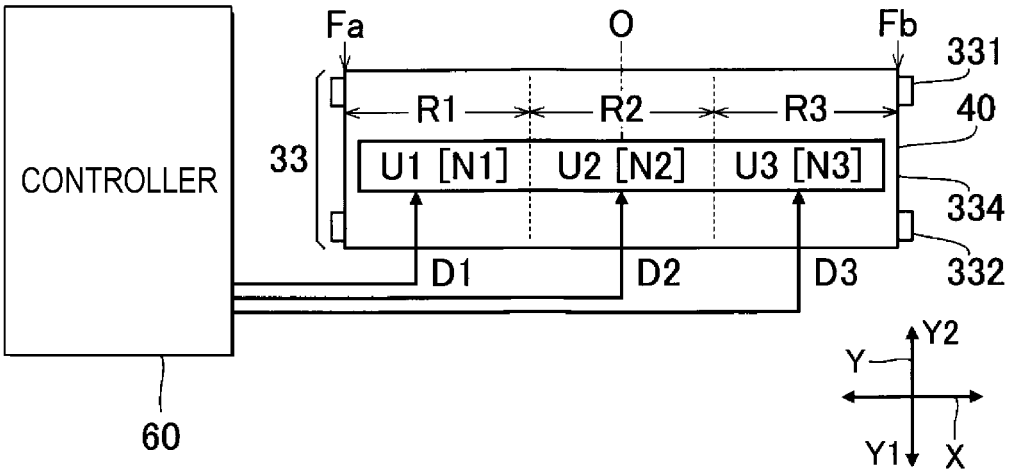
FIG. 15 is a block diagram illustrating part of the structure of a liquid ejecting apparatus in a variation.

(2) FIG. 15 illustrates part of the structure of a liquid ejecting apparatus 100 in a variation applicable to the above embodiments. As illustrated in FIG. 15, the outer circumferential surface of the transport belt 334 is divided into three regions R1 to R3 along the X-axis. The region R2 is located between the region R1 and the region R3. The region R1 includes a circumferential edge Fa of the transport belt 334. The region R3 includes a circumferential edge Fb of the transport belt 334. The region R2 internally includes the center line O of the transport belt 334. The center line O is a straight line along the Y-axis, along which a medium 11 is transported.

The amount of charges on the transport belt 334 may vary depending on the position on the transport belt 334 in its width direction. Specifically, there is a tendency that the amount of charges at the central portion on the transport belt 334 on the width direction is larger than at both ends of the transport belt 334 in the width direction. On the transport belt 334, therefore, the amount of charges in the region R2 close to the center line O is larger than in the region R1 close to the circumferential edge Fa and in the region R3 close to the circumferential edge Fb.

The liquid ejecting head 40 has three unit head portions U1 to U3 corresponding to different regions Rk (k is any value from 1 to 3). A separate driving signal Dk is supplied from the control unit 20 to each of the three unit head portions U1 to U3, as in the fifth embodiment. In the description below, each nozzle N in the unit head portion Uk will be referred to as the nozzle Nk. The nozzle N1 and nozzle N3 are each an example of a first nozzle. The nozzle N2 is an example of a second nozzle. The pressure chamber C corresponding to the nozzle N1 or nozzle N3 is an example of a first pressure chamber. The pressure chamber C corresponding to the nozzle N2 is an example of a second pressure chamber.

The plurality of nozzles N1 in the unit head portion U1 face the region R1 on the transport belt 334. Similarly, the plurality of nozzles N2 in the unit head portion U2 face the region R2 on the transport belt 334, and the plurality of nozzles N3 in the unit head portion U3 face the region R3 on the transport belt 334. Therefore, the nozzle N1 is closer to the circumferential edge Fa of the transport belt 334 than is the nozzle N2 in plan view, and the nozzle N3 is closer to the circumferential edge Fb of the transport belt 334 than is the nozzle N2 in plan view. The nozzle N2 is closer to the center line O than are the nozzle N1 and nozzle N3 in plan view.

The controller 60, correctively referring to 60A, 60B, 60C, 60D and 60E, controls the micro-vibration pulse Pb of a driving signal Dk so that, among the plurality of pressure chambers C, the intensity of micro-vibration generated in the pressure chamber C corresponding to the nozzle N2 is larger than the intensity of micro-vibration generated in the pressure chamber C corresponding to the nozzle N1 or N3. Specifically, the amplitude A of the micro-vibration pulse Pb in the driving signal D2 is larger than the amplitude A of the micro-vibration pulse Pb in the driving signal D1 or D3.

As exemplified above, the intensity of micro-vibration generated in the pressure chamber C corresponding to the nozzle N2 is larger than the intensity of micro-vibration generated in the pressure chamber C corresponding to the nozzle N1 or N3. This is advantageous in that even when the amount of charges is uneven in that the amount of charges at the central portion on the transport belt 334 in its width direction is larger than at both ends of the transport belt 334 in the width direction, ink can be appropriately agitated in both the pressure chamber C corresponding to the nozzle N1 or N3 and the pressure chamber C corresponding to the nozzle N2. The variation exemplified above can be applied to all of the first to fifth embodiments described above.

(3) Although, in the first and second embodiments, a state in which the transport belt 334 in the electrified state is rotating has been exemplified as the first state, the first state is not limited to the above exemplary state. For example, even when the transport belt 334 electrified by the electrifying section 34 is stopping, a state before charges are sufficiently removed is equivalent to the first state. As understood from the above, the first state refers to a state in which the transport belt 334 in the electrified state faces nozzles N, regardless of whether the electrifying section 34 is operating or whether the transport belt 334 is rotating.

(4) Although, in the first and second embodiments, a state in which the transport belt 334 is not electrified has been exemplified as the second state, the second state is not limited to the above exemplary state. In a structure in which the transport belt 334 can be retracted to a position at which the transport belt 334 does not face plurality of nozzles N (this position is referred to below as the standby position), a state in which the transport belt 334 is at the standby position is applicable as the second state, regardless of whether the transport belt 334 has been electrified. When the liquid ejecting head 40 has moved to a position at which a plurality of nozzles N do not face the transport belt 334, relative to the transport belt 334, this state is also applicable as the second state. In a structure in which a plurality of first destaticizing devices 35 that remove charges on the transport belt 334 are provided upstream of the liquid ejecting head 40 and downstream of the electrifying section 34, a state in which charges supplied from the electrifying section 34 have been removed by the plurality of first destaticizing devices 35 is equivalent to the second state. In a state in which the transport belt 334 is stopping, when charges on the transport belt 334 are removed by the second destaticizing device 36 with the electrifying section 34 stopping or are removed due to time-dependent natural destaticization, the second state in which the transport belt 334 is not electrified is entered. As understood from the above, the second state refers to a state in which the amount of charges on the transport belt 334 is adequately small (typically, a non-electrified state), regardless of whether the electrifying section 34 is operating or the transport belt 334 is rotating.

(5) Although, in the embodiments described above, the amplitude A of the micro-vibration pulse Pb has been adjusted according to the amount of charges on the transport belt 334, the method of adjusting the intensity of micro-vibration is not limited to the above exemplary method. For example, the gradient of the micro-vibration pulse Pb may be controlled in a segment in which the voltage rises, according to the amount of charges on the transport belt 334. For example, the controller 60 raises the intensity of micro-vibration by increasing the gradient of the micro-vibration pulse Pb (that is, the rate of change in voltage) so that the larger the amount of charges on the transport belt 334 is, the larger the gradient of the micro-vibration pulse Pb is. Alternatively, the number of times micro-vibration is generated may be controlled according to the amount of charges on the transport belt 334. For example, the controller 60 increases the number of times the micro-vibration pulse Pb is supplied so that the larger the amount of charges on the transport belt 334 is, the larger the number of micro-vibration pulse Pb supplies is.

(6) Two or more of the first to fifth embodiments may be combined. For example, the fifth embodiment may be applied to any one of the first to fourth embodiment. Alternatively, another structure for adjusting the intensity of micro-vibration may be combined with the first to fifth embodiments. For example, a structure for adjusting the intensity of micro-vibration according to the temperature in the environment in which the liquid ejecting apparatus 100 is used may be applied to the first to fifth embodiments.

A structure for adjusting the intensity of micro-vibration according to the amount by which the transport belt 334 has been used may be applied to the first to fifth embodiments. It is assumed that there is a tendency that the more the transport belt 334 has been used (for example, the larger the total amount of transportation is), the less likely the transport belt 334 is to be electrified. Therefore, a preferable structure is such that the more the transport belt 334 has been used, the more the intensity of micro-vibration is reduced. After maintenance work such as the replacement or cleaning of the transport belt 334 is performed, the amount by which the transport belt 334 has been used is initialized.

A structure for adjusting the intensity of micro-vibration according to the amount by which the electrifying section 34 has been used may be applied to the first to fifth embodiments. The more the electrifying section 34 has been used (for example, the larger the total amount of operation time is), the more the ability of the electrifying section 34 to electrify the transport belt 334 is lowered. Therefore, a preferable structure is such that the more the electrifying section 34 has been used, the more the intensity of micro-vibration is reduced.

A structure for adjusting the intensity of micro-vibration according to the amount by which the first destaticizing device 35 has been used may be applied to the first to fifth embodiments. The more the first destaticizing device 35 has been used (for example, the larger the total amount of operation time is), the more paper dust adheres to the brush 351 of the first destaticizing device 35, for example. As a result, the amount of the amount of charges on the transport belt 334 is increased. Therefore, a preferable structure is such that the more the first destaticizing device 35 has been used, the more the intensity of micro-vibration is raised.

(7) In the embodiments described above, the liquid ejecting apparatus 100 of line type in which a plurality of nozzles N are distributed over the whole width of the medium 11 has been exemplified. However, the present disclosure is also applied to a serial liquid ejecting apparatus in which the liquid ejecting head 40 is bidirectionally moved along the X-axis. In a serial liquid ejecting apparatus, an example of the second state is a state in which the liquid ejecting head is at the standby position at which the liquid ejecting head does not face a medium.

(8) The liquid ejecting apparatus 100 exemplified in the embodiments described above can be applied not only to devices used only for printing but also to other various devices such as facsimile machines and copiers. Of course, applications of the liquid ejecting apparatus 100 are not limited to printing. For example, a liquid ejecting apparatus that ejects a color material solution is used as a manufacturing apparatus that forms color filters for display devices such as liquid crystal display panels. In another example, a liquid ejecting apparatus that ejects a conductive material solution is used as a manufacturing apparatus that forms wires and electrodes on wiring boards. In yet another example, a liquid ejecting apparatus that ejects a bio-organic substance solution is used as a manufacturing apparatus that manufactures biochips.

G: Notes

Structures described below, for example, are comprehended from the embodiments exemplified above.

A liquid ejecting apparatus according to a preferable aspect (first aspect) has a nozzle that ejects a liquid, a pressure chamber communicating with the nozzle, a piezoelectric element that varies pressure in the pressure chamber, an endless transport belt that transports a medium, an electrifying section that electrifies the transport belt, and a driving circuit that supplies, to the piezoelectric element, a micro-vibration pulse that generates micro-vibration in the liquid in the pressure chamber without causing the liquid to be ejected from the nozzle. The micro-vibration pulse is varied according to first data related to the state of a meniscus in the nozzle in a first state in which the nozzle and the transport belt electrified by the electrifying section face each other. Since, in this aspect, the micro-vibration pulse is varied according to the first data related to the state of the meniscus in the nozzle in the first state, even when the state of the meniscus is affected by charges on the transport belt, the liquid in the pressure chamber can be appropriately agitated by micro-vibration.

In a preferred example (second aspect) of the first aspect, the first data represents the property of residual vibration in the pressure chamber when the liquid in the pressure chamber is vibrated in the first state. The property of residual vibration in the pressure chamber varies depending on the effect of charges on the transport belt on the meniscus. In the aspect described above in which the micro-vibration pulse is controlled according to the first data that represents the property of residual vibration in the pressure chamber, the liquid in the pressure chamber can be appropriately agitated without a need for a structure for directly detecting the state of the meniscus.

The liquid ejecting apparatus according to a preferred example (third aspect) of the first aspect has a sensor that detects the position of the meniscus in the nozzle. The first data represents the position of the meniscus detected by the sensor in the first state. Since, in this aspect, the micro-vibration pulse is controlled according to the first data represents the position of the meniscus, the liquid in the pressure chamber can be appropriately agitated according to the actual effect of charges on the transport belt on the meniscus.

In a preferred example (fourth aspect) of any one of the first to third aspects, the micro-vibration pulse is varied according to the result of a comparison between the first data and second data related to the state of the meniscus in a second state in which the nozzle and the transport belt electrified by the electrifying section do not face each other. In this aspect, since the micro-vibration pulse is varied according to the result of a comparison between the first data in the first state in which the meniscus is affected by charges on the transport belt and the second data in the second state in which the meniscus is not affected by charges on the transport belt, even when the state of the meniscus is affected by charges on the transport belt, the liquid in the pressure chamber can be sufficiently agitated by micro-vibration.

In a preferred example (fifth aspect) of the fourth aspect, the first state is a state in which the transport belt is rotating and the second state is a state in which the transport belt is stopping. Since, in this aspect, the micro-vibration pulse is controlled according to the result of a comparison between the first data in the first state in which the transport belt is rotating and the second data in the second state in which the transport belt is stopping, the liquid in the pressure chamber can be sufficiently agitated by micro-vibration.

A liquid ejecting apparatus according to another aspect (sixth aspect) has a nozzle that ejects a liquid, a pressure chamber communicating with the nozzle, a piezoelectric element that varies pressure in the pressure chamber, an endless transport belt that transports a medium, an electrifying section that electrifies the transport belt, and a driving circuit that supplies, to the piezoelectric element, a micro-vibration pulse that generates micro-vibration in the liquid in the pressure chamber without causing the liquid to be ejected from the nozzle. The micro-vibration pulse is varied according to the position at which the liquid ejected to the medium lands, the medium being transported by the transport belt electrified by the electrifying section. Since, in this aspect, the micro-vibration pulse is varied according to the position at which the liquid lands with the transport belt electrified, even when the state of the meniscus is affected by charges on the transport belt, the liquid in the pressure chamber can be appropriately agitated by micro-vibration.

In a preferred example (seventh aspect) of any one of the first to sixth aspects, the micro-vibration pulse is varied according to the rotational speed of the transport belt. In this aspect, it is possible to generate, in the pressure chamber, micro-vibration with intensity appropriate to the rotational speed of the transport belt.

The liquid ejecting apparatus according to a preferred example (eighth aspect) of any one of the first to seventh aspects has a plurality of nozzles including the nozzle described above and also has a plurality of pressure chambers including the pressure chamber described above, each of the plurality of pressure chambers corresponding to one of the plurality of nozzles. The plurality of nozzles include a first nozzle and a second nozzle. The first nozzle is closer to a circumferential edge of the transport belt than is the second nozzle in plan view. The second nozzle is closer to a center line along a direction in which the medium is transported by the transport belt than is the first nozzle in plan view. The intensity of micro-vibration generated in the liquid in a second pressure chamber included in the plurality of pressure chambers in correspondence to the second nozzle is higher than the intensity of micro-vibration generated in the liquid in a first pressure chamber included in the plurality of pressure chambers in correspondence to the first nozzle. Since, in this aspect, the intensity of micro-vibration given to the liquid in the second pressure chamber is higher than the intensity of micro-vibration given to the liquid in the first pressure chamber, even when the amount of charges is uneven in that the amount of charges in the vicinity of the center line of the transport belt is larger than in the vicinity of an outer circumferential edge of the transport belt, the liquid can be appropriately agitated in both the first pressure chamber and the second pressure chamber.

A liquid ejecting apparatus controlling method according to a preferable aspect (ninth aspect) is a method of controlling a liquid ejecting apparatus that has a nozzle that ejects a liquid, a pressure chamber communicating with the nozzle, a piezoelectric element that varies pressure in the pressure chamber, an endless transport belt that transports a medium, an electrifying section that electrifies the transport belt, and a driving circuit that supplies, to the piezoelectric element, a micro-vibration pulse that generates micro-vibration in the liquid in the pressure chamber without causing the liquid to be ejected from the nozzle. The method controls the micro-vibration pulse according to first data related to the state of a meniscus in the nozzle in a first state in which the nozzle and the transport belt electrified by the electrifying section face each other. Since, in this aspect, the micro-vibration pulse is controlled according to the first data related to the state of the meniscus in the nozzle in the first state, even when the state of the meniscus is affected by charges on the transport belt, the liquid in the pressure chamber can be appropriately agitated by micro-vibration.

What is claimed is:

1. A liquid ejecting apparatus comprising:

a first nozzle configured to eject a liquid;

a first pressure chamber communicating with the first nozzle;

a first piezoelectric element varying a pressure in the first pressure chamber;

an endless transport belt transporting a medium;

an electrifying section electrifying the transport belt; and a driving circuit supplying, to the first piezoelectric element, a micro-vibration pulse that generates a micro-vibration in the liquid in the first pressure chamber without causing the liquid to be ejected from the first nozzle; wherein the micro-vibration pulse is varied according to first data related to a state of a meniscus in the first nozzle in a first state in which the first nozzle and the transport belt electrified by the electrifying section mutually face.

2. The liquid ejecting apparatus according to claim 1, wherein the first data represents a property of a residual vibration in the first pressure chamber when the liquid in the first pressure chamber is vibrated in the first state.

3. The liquid ejecting apparatus according to claim 1, further comprising a sensor configured to detect a position of the meniscus in the first nozzle, wherein the first data represents the position of the meniscus detected by the sensor in the first state.

4. The liquid ejecting apparatus according to claim 1, wherein the micro-vibration pulse is varied according to a result of a comparison between the first data and second data related to the state of the meniscus in a second state in which the first nozzle and the transport belt electrified by the electrifying section do not mutually face.

5. The liquid ejecting apparatus according to claim 4, wherein:

the first state is a state in which the transport belt is rotating; and the second state is a state in which the transport belt is stopping.

6. The liquid ejecting apparatus according to claim 1, wherein the micro-vibration pulse is varied according to a rotational speed of the transport belt.

7. The liquid ejecting apparatus according to claim 1, further comprising:

a second nozzle configured to eject a liquid;

a second pressure chamber communicating with the second nozzle; and a second piezoelectric element varying a pressure in the second pressure chamber; wherein the first nozzle is closer to a circumferential edge of the transport belt than is the second nozzle in plan view, the second nozzle is closer to a center line of the transport belt than is the first nozzle in plan view, the center line extending in a direction in which the medium is transported by the transport belt, and an intensity of the micro-vibration generated in the liquid in the second pressure chamber corresponding to the second nozzle is higher than an intensity of the micro-vibration generated in the liquid in the first pressure chamber corresponding to the first nozzle.

8. A liquid ejecting apparatus comprising:

a first nozzle configured to eject a liquid;

a first pressure chamber communicating with the first nozzle;

a first piezoelectric element varying a pressure in the first pressure chamber;

an endless transport belt transporting a medium;

an electrifying section electrifying the transport belt; and a driving circuit supplying, to the first piezoelectric element, a micro-vibration pulse that generates a micro-vibration in the liquid in the first pressure chamber without causing the liquid to be ejected from the first nozzle; wherein the micro-vibration pulse is varied according to a position at which the liquid ejected to the medium lands, the medium being transported by the transport belt electrified by the electrifying section lands.

9. The liquid ejecting apparatus according to claim 8, wherein the micro-vibration pulse is varied according to a rotational speed of the transport belt.

10. The liquid ejecting apparatus according to claim 8, further comprising:

a second nozzle configured to eject a liquid;

a second pressure chamber communicating with the second nozzle; and a second piezoelectric element varying a pressure in the second pressure chamber; wherein the first nozzle is closer to a circumferential edge of the transport belt than is the second nozzle in plan view, the second nozzle is closer to a center line of the transport belt than is the first nozzle in plan view, the center line extending in a direction in which the medium is transported by the transport belt, and an intensity of the micro-vibration generated in the liquid in the second pressure chamber corresponding to the second nozzle is higher than an intensity of the micro-vibration generated in the liquid in the first pressure chamber corresponding to the first nozzle.

11. A method of controlling a liquid ejecting apparatus that has:

a nozzle configured to eject a liquid;

a pressure chamber communicating with the nozzle;

a piezoelectric element that varying a pressure in the pressure chamber;

an endless transport belt transporting a medium;

an electrifying section electrifying the transport belt; and a driving circuit supplying, to the piezoelectric element, a micro-vibration pulse that generates a micro-vibration in the liquid in the pressure chamber without causing the liquid to be ejected from the nozzle, wherein the method controls the micro-vibration pulse according to first data related to a state of a meniscus in the nozzle in a first state in which the nozzle and the transport belt electrified by the electrifying section mutually face.

* * * * *